US011826923B2

(12) United States Patent
Kopelas

(10) Patent No.: US 11,826,923 B2
(45) Date of Patent: Nov. 28, 2023

(54) SHAVING HEADS

(71) Applicant: Bic Violex S.A., Anoixi (GR)

(72) Inventor: Panagiotis Kopelas, Anoixi (GR)

(73) Assignee: BIC Violex Single Member S.A., Anoixi (GR)

( * ) Notice: Subject to any disclaimer, the term of this patent is extended or adjusted under 35 U.S.C. 154(b) by 116 days.

(21) Appl. No.: 17/449,172

(22) Filed: Sep. 28, 2021

(65) Prior Publication Data

US 2022/0097244 A1 Mar. 31, 2022

(30) Foreign Application Priority Data

Sep. 29, 2020 (EP) ..... 20199064

(51) Int. Cl.
*B26B 21/34* (2006.01)
*B26B 21/40* (2006.01)
*B26B 21/22* (2006.01)

(52) U.S. Cl.
CPC ..... *B26B 21/34* (2013.01); *B26B 21/4012* (2013.01); *B26B 21/22* (2013.01)

(58) Field of Classification Search
CPC ..... B26B 21/00; B26B 21/14; B26B 21/22; B26B 21/222; B26B 21/227; B26B 21/34; B26B 21/4012
See application file for complete search history.

(56) References Cited

U.S. PATENT DOCUMENTS 1,788,547 A * 1/1931 Shaler ..... B26B 21/38 30/45
2,101,737 A 12/1937 Gesler
5,007,169 A * 4/1991 Motta ..... B26B 21/38 30/45
5,046,249 A * 9/1991 Kawara ..... B26B 21/38 30/44
5,678,311 A * 10/1997 Avidor ..... B26B 21/34 30/34.2
7,251,894 B2 * 8/2007 Zuidervaart ..... B26B 19/00 30/34.2
8,887,401 B2 * 11/2014 Oxford ..... B26B 21/34 30/41.6

(Continued)

FOREIGN PATENT DOCUMENTS

DE 102004020650 A1 11/2005
EP 3444084 A1 2/2019

(Continued)

OTHER PUBLICATIONS

European Search Report issued in EP 20199064.5 dated Mar. 9, 2021 (6 pages).

*Primary Examiner* — Adam J Eiseman
*Assistant Examiner* — Richard D Crosby, Jr.
(74) *Attorney, Agent, or Firm* — Bookoff McAndrews, PLLC

(57) ABSTRACT

The present disclosure relates to a shaving head configured to be moved along a shaving direction relative to skin during shaving of the skin, the shaving head including a housing, one or more blades mounted within the housing, and a hair moving mechanism connected to the housing and arranged in the shaving direction relative to the one or more blades, wherein the hair moving mechanism is configured to move hair relative to the skin in a direction towards the one or more blades during shaving. A shaver including same.

20 Claims, 2 Drawing Sheets

(56) References Cited

U.S. PATENT DOCUMENTS

| | | | | |
|---|---|---|---|---|
| 10,093,031 | B2 * | 10/2018 | Ren | B26B 21/34 |
| 10,384,359 | B2 * | 8/2019 | Houbolt | B26B 21/22 |
| 10,889,016 | B2 * | 1/2021 | Davos | B26B 19/282 |
| 2001/0015017 | A1 * | 8/2001 | Brzesowsky | B26B 21/38 30/43.92 |
| 2005/0198826 | A1 | 9/2005 | Segrea | |
| 2007/0089297 | A1 * | 4/2007 | Houbolt | B26B 21/34 30/34.2 |
| 2011/0146079 | A1 * | 6/2011 | Clarke | B26B 21/4068 30/34.05 |
| 2011/0173816 | A1 * | 7/2011 | Ben-Ari | B26B 21/34 30/43.6 |
| 2013/0111760 | A1 * | 5/2013 | Coffin | B26B 21/443 30/41 |
| 2016/0207210 | A1 * | 7/2016 | Ren | B26B 21/227 |

FOREIGN PATENT DOCUMENTS

| | | | |
|---|---|---|---|
| EP | 3590669 | A1 | 1/2020 |
| WO | 9906190 | A1 | 2/1999 |
| WO | 2019141482 | A1 | 7/2019 |
| WO | 2019141488 | A1 | 7/2019 |

* cited by examiner

SHAVING HEADS

CROSS REFERENCE TO RELATED APPLIACTIONS

This application claims benefit from European patent application EP20199064.5, filed on 29 Sep. 2020, its content being incorporated herein by reference.

FIELD

The present disclosure relates to the field of shavers and shaving heads therefor.

BACKGROUND

Shaving performance is frequently evaluated in terms of criteria such as comfort and closeness. Comfort is typically evaluated in terms of sensations perceived by skin as it is being shaved, and/or in terms of sensations perceived by the shaved skin minutes to hours after shaving has been completed. Closeness is typically evaluated in terms of the visual and/or tactile perceptibility of hair beyond the exposed surface of skin immediately after shaving or within the first few (for example twelve or fewer) hours after shaving.

The manner in which a shaver's blade contacts hair and the exposed surface of skin plays a significant role in both comfort (during shaving and afterwards), and closeness.

The document EP3590669A1 discloses a shaving head, including a housing, blades, and a mechanism by which a user may adjust an amount of pressure with which the blades are able to bear on skin during shaving.

The document WO2019141482A1 discloses a shaving head, including a housing, blades, and a mechanism by which a user may adjust angles of the blades.

The document WO2019141488A1 discloses a shaving head, including a housing, a blade, and a mechanism by which a user may actuate the blade in a direction orthogonal to a cutting edge of the blade.

The document EP3444084A1 discloses a shaving head, including a housing, blades, and one or more rollers configured to stretch skin as it is in contact with the shaving head.

The document DE102004020650A1 discloses a shaving head including a housing, blades, and a mechanism for adjusting the angle of the blades.

Although a strand of hair typically extends into a follicle formed in the skin beneath the exposed surface of the skin, the so-called length of a given strand of hair typically refers only to an amount by which the strand is extends away from the follicle, protruding past the exposed surface of the skin. As used herein, a distance measured along the length of a strand of hair should be understood to be measured starting from the exposed surface of the skin. It should also be understood that when a phenomenon or characteristic is described as being present within the first X millimeters of length of a strand of hair, that the strand of hair may very well have a length of less than X millimeters, in which case the description would be applicable for the entire length of the strand of hair.

Long-term changes in the length of a given strand of hair typically occur as a result of natural phenomena such as hair growth. External forces applied to the strand of hair may also affect its length. For example, tension applied to the exposed portion of the strand of hair may cause also cause a short-term increase in the strand's length.

Typically, within the first millimeter, or as much as the first five millimeters of its length, a given strand of hair protrudes from the exposed surface of the skin along a direction that includes both a normal component, which is normal to the exposed surface of the skin, and also, what is referred to herein as a "grain component," which a component that is parallel/tangent to the exposed surface of the skin. It is possible that two or more adjacent strands of hair may have grain components which are non-parallel to one another.

Typically, during shaving, a blade is able to provide a closer shave when the blade is moved generally opposite to the strand's grain component than when it is moved generally in the same direction as the strand's grain component. However, many users associate such movement with discomfort during the act of shaving itself, and/or with increased irritation (and associated discomfort subsequent to the act of shaving) as compared to movement of the blade in the same direction as the grain component. Although one or more of the above-mentioned shavers may allow a user to adjust parameters of the shaver, such adjustments merely allow a user to improve comfort by reducing closeness until shaving in the opposite direction to the grain component becomes tolerable. There is therefore a need to improve shaving closeness when shaving in the same direction as the grain component of hair.

SUMMARY

According to an example of the present disclosure, a shaving head may be provided which is configured to be moved along a shaving direction relative to skin during shaving of the skin. The shaving head includes a housing, one or more blades mounted within the housing, and a hair moving mechanism connected to the housing. The hair moving mechanism is arranged in the shaving direction relative to the one or more blades, and configured to move hair relative to the skin in a direction towards the one or more blades during shaving.

The hair moving mechanism may include a hair moving surface which is arranged towards the skin during shaving.

The shaving head may include a drive mechanism configured to move the hair moving surface relative to the housing in response to a movement of the skin relative to the housing.

The hair moving surface may include one or more fins configured to sweep the skin during shaving.

The drive mechanism may be configured to convert the movement of the skin relative to the housing into movement of the hair moving surface relative to the housing.

The drive mechanism may include one or more driving wheels arranged to contact the skin.

The drive mechanism may include a drivetrain connecting the one or more driving wheels to the hair moving surface.

At least one of the one or more driving wheels may be located laterally of a shaving area with respect to the shaving direction. The shaving area is an area in which the one or more blades may cut hair during shaving.

The drivetrain may include a gear set linking the driving wheel(s) to the hair moving surface.

The hair moving surface may be provided on a roller mounted rotatably in the housing so as to be rotatable by the drive mechanism.

The roller may be configured to rotate faster than the driving wheel(s).

The roller may be configured to rotate at least twice as fast as the driving wheel(s).

The hair moving surface may be configured to move faster with respect to the housing than the movement of the skin with respect to the housing.

The hair moving surface may be configured to move at least twice as fast with respect to the housing as the movement of the skin with respect to the housing.

The shaving head may include a skin tensioning device arranged in the shaving direction relative to the hair moving mechanism.

The hair moving mechanism may include a polymer-containing material arranged to contact the skin during shaving.

According to an example of the present disclosure, a shaver may be provided, including a shaving head as described earlier herein.

Such a shaving head may provide relative closeness and relative comfort even when the shaving direction is not oriented generally opposite to the grain component.

BRIEF DESCRIPTION OF THE DRAWINGS

The disclosure may be more completely understood in consideration of the following detailed description of aspects of the disclosure in connection with the accompanying drawings, in which.

Figure 1:
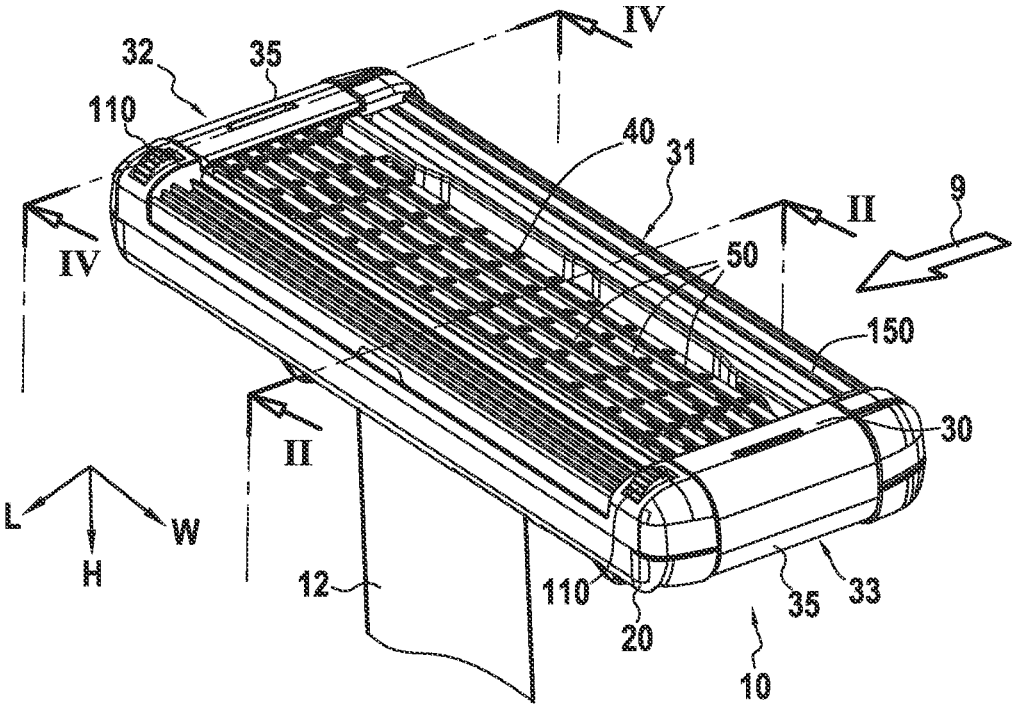
FIG. 1 shows a shaver.

The term "exemplary" is used in the sense of "example," rather than "ideal." While aspects of the disclosure are amenable to various modifications and alternative forms, specifics thereof have been shown by way of example in the drawings and will be described in detail. It should be understood, however, that the intention is not to limit aspects of the disclosure to the particular embodiment(s) described. On the contrary, the intention of this disclosure is to cover all modifications, equivalents, and alternatives falling within the scope of the disclosure.

DETAILED DESCRIPTION

As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

The following detailed description should be read with reference to the drawings. The detailed description and the drawings, which are not necessarily to scale, depict illustrative aspects and are not intended to limit the scope of the disclosure. The illustrative aspects depicted are intended only as exemplary.

When an element or feature is referred to herein as being "on," "engaged to," "connected to," or "coupled to" another element or feature, it may be directly on, engaged, connected, or coupled to the other element or feature, or intervening elements or features may be present. In contrast, when an element or feature is referred to as being "directly on," "directly engaged to," "directly connected to," or "directly coupled to" another element or feature, there may be no intervening elements or features present. Other words used to describe the relationship between elements or features should be interpreted in a like fashion (for example, "between" versus "directly between," "adjacent" versus "directly adjacent," etc.).

Although the terms "first," "second," etc. may be used herein to describe various elements, components, regions, layers, sections, and/or parameters, these elements, components, regions, layers, sections, and/or parameters should not be limited by these terms. These terms are only used to distinguish one element, component, region, layer, or section from another region, layer, or section. Thus, a first element, component, region, layer, or section discussed herein could be termed a second element, component, region, layer, or section without departing from the teachings of the present disclosure.

As used herein, a so-called length of hair refers to a rough estimate of the average length of the individual strands of hair located within a given area. Such a rough estimate may be accurate to within five millimeters, for example.

The term "grain direction" as used herein refers to a rough estimate of an average orientation of the grain components of the strands of hair within a given area. Such a rough estimate may be accurate to within ninety degrees, for example.

FIG. 1 shows an exemplary shaver 10 including an exemplary handle 12 and an exemplary shaving head 20. The handle 12 may be connected permanently or removably to the shaving head 20 in any known manner. Although, in the example illustrated here, the handle 12 extends from the shaving head 20 generally along a height direction H of the shaving head 20, other orientations of the handle 12 with respect to the shaving head 20 are contemplated.

The shaving head 20 includes a housing 30, and presents a shaving area 40 in which the cutting edge of at least one blade 50 is presented. During shaving, hair moves relative to the shaving head 20 and enters the shaving area 40, where it may be cut by the blade(s) 50 whose cutting edge(s) is/are presented therein.

Each blade 50 of the shaving head 20 whose cutting edge is present in the shaving area 40 may be connected to the housing 30 in any known manner, and is arranged such that its cutting edge extends generally in a width direction W of the shaving head 20.

In the example illustrated here, the shaving head 20 includes five blades 50 whose cutting edges are arranged within the shaving area 40. Other quantities are also contemplated, such as two, three, or four blades 50, or even six or more blades 50.

During shaving, the housing 30 is brought into contact with skin such that at least one cutting edge located in the shaving area 40 is also brought into contact with the skin, and may be maneuvered in a shaving direction 9 with respect to the skin in order to cut hair on the skin. In the example illustrated here, the shaving direction 9 is generally perpendicular to the width direction W of the shaving head 20, and is generally parallel to a length direction L of the shaving head 20.

Each blade 50 whose cutting edge is arranged within the shaving area 40 may be oriented so as to extend from its cutting edge in a direction which has one component in the height direction H and one component opposite to the shaving direction 9.

In the example illustrated here, housing 30 includes a rear portion 31 which is arranged in a direction opposite to the shaving direction 9 with respect to the blade(s) 50 whose edge(s) is/are presented in the shaving area 40, and two lateral portions 32, 33. The lateral portions 32, 33 are arranged on opposite extremities of the rear portion 31, and extend therefrom in the shaving direction 9 towards a front portion 34 of the housing 30. The front portion 34 is arranged in the shaving direction 9 with respect to the blade(s) 50 whose cutting edges are arranged in the shaving area 40.

The blade(s) 50 whose cutting edge(s) is/are arranged in the shaving area 40 may be connected to the housing 30 via the lateral portions 32, 33. Although, in the example illustrated here, each of the lateral portions 32, 33 includes a core presenting one or more slots, into which is/are inserted the blade(s) 50 whose cutting edge(s) is/are arranged in the shaving area 40, and a retainer 35 to retain the blade(s) 50 within the slot(s) (as for example in U.S. Pat. No. 9,539,734), it is contemplated to connect the blade(s) 50 whose cutting edge(s) are presented in the shaving area 40 to the lateral portions 32, 33 in any known method for attaching one or more blades to a housing.

The shaving head 20 includes a hair moving mechanism 60 which is connected to the housing 30 so as to be arranged in the shaving direction 9 with respect to the blades 50 whose edges are presented in the shaving area 40. Such placement may allow movement of the shaving head 20 on the skin to bring hair extending from the skin into contact with the hair moving mechanism 60 before bringing it into contact with the blade(s) 50 whose cutting edge(s) is/are present in the shaving area 40. As seen in the example illustrated here, the hair moving mechanism 60 may be housed within the front portion 34 of the housing 30.

As will be discussed in greater detail with respect to FIG. 3-4, the hair moving mechanism 60 is configured to move hair relative to the skin during shaving, such that the hair is moved towards the cutting edge(s) arranged in the shaving area 40. As the hair moving mechanism 60 moves a given strand of hair, it may temporarily change the strand's grain component, and/or lead to a localized change in grain direction of hair of the portion of skin brought into contact with the shaving area 40 of the shaving head 20. Such changes in strands' grain components, or such a change in the grain direction, may improve ability of the oncoming blades 50 to provide a close shave.

The hair moving mechanism 60 may include a polymer-containing material arranged to contact the skin during shaving. Non-limiting examples of the polymer contained in the polymer-containing material include one or more rubbers, one or more thermoplastic elastomers (TPEs) one or more plastics (including but not limited to acrylonitrile butadiene styrene, also known as "ABS"), or combinations thereof. Each of these polymers is also a non-limiting example of a polymer-containing material. Other non-limiting examples of polymer-containing materials include mixtures of any of these polymers with any other material, regardless of whether said any other material is itself one of these polymers or polymer-containing materials.

In examples, the shaving head 20 also includes a skin tensioning device 140 which is arranged in the shaving direction 9 with respect to the hair moving mechanism 60 (in this case on the front portion 34). Such placement of the skin tensioning device 140 may allow movement of the shaving head 20 on the skin to bring the skin into contact with the skin tensioning device 140 before bringing the skin into contact with the hair moving mechanism 60. During shaving, skin and hair which are made to contact the shaving area 40 of the shaving head may be contacted by the hair moving mechanism 60 after being contacted by the skin tensioning device 140 and before being contacted by the blade(s) 50 whose cutting edge(s) is/are in the shaving area 40.

Although the skin tensioning device 140 illustrated here is represented as a series of three so-called "guard fins," it is also contemplated to provide as few as one or two guard fins, or even as many as four or more guard fins. Moreover, it is also contemplated, in addition to or as an alternative to one or more guard fins, for the skin tensioning device 140 to provide a lubricating function. The skin tensioning device 140 may be provided as any known component for a shaving head that is arranged to contact skin as the skin moves towards the blade(s) thereof.

In examples, the shaving head 20 also includes a post-shave device 150 (in this case a lubricating element), which is arranged in an opposite direction to the shaving direction 9 with respect to the shaving area 40 (in this case on the rear portion 31). The post-shave device 150 may be configured to contact skin as the skin leaves the shaving area 40, for example in order to soothe the skin and/or to apply one or more products thereto. The post-shave device 150 may be provided as any known component for a shaving head that is arranged to contact skin after the skin has contacted one or more blades of the shaving head.

Figure 2:
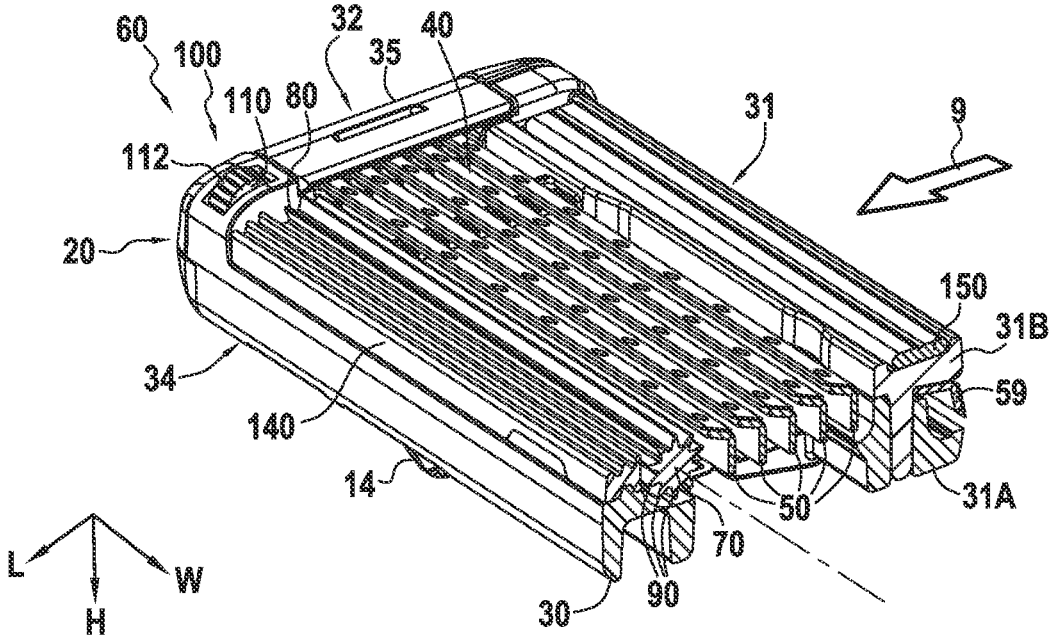
FIG. 2 shows a cut view of a shaving head visible in FIG. 1, as taken with respect to cut plane II-II.

FIG. 2 shows a cut view of the shaving head 20 visible in FIG. 1, as taken with respect to cut plane II-II.

In examples, the shaving head 20 includes a so-called "additional trimming" (or "precision") blade 59, whose cutting edge is outside of the shaving area 40. Although the additional trimming blade 59 seen here is arranged to present its cutting edge on a rear surface of the rear portion 31, such a placement is not intended to be limiting, and other placements of the cutting edge outside of the shaving area 40 are also contemplated for an additional trimming blade 59, should one be provided. Moreover, although the example illustrated here includes only one additional trimming blade 59, it is also contemplated to provide multiple additional trimming blades.

In the examples, the rear portion 31 may include a first portion 31A and a second portion 31B which are assembled together. For example, as seen in FIG. 2, the first 31A portion may present a slot in which the second portion 31B (also called a "cap") is receivable. Such a configuration may facilitate provision of the additional trimming blade(s) 59 and/or the post-shave device 150, for example, by allowing it to be attached to the second portion 31B prior assembly of the second portion 31B to the first portion 31A. However, it is also contemplated to use any conventional architecture for a rear portion 31 of a housing 30 of a shaving head 20, regardless of whether a post-shave device 150 or additional trimming blade(s) 59 is/are to be provided.

The front portion 34 and the rear portion 31 (or at least the first portion 31A of the rear portion 31, when the rear portion 31 is composed of multiple portions) may be assembled together, or may be constructed monolithically with one another—as seen in the examples. In the case the front portion 34 and rear portion 31 are assembled together, a given lateral portion 32, 33 may be formed monolithically with the front portion 34 or the (first portion 31A of the) rear portion 31, or may be formed independently of the front portion 34 and rear portion 31 and assembled to each.

The shaving head 20 includes a connection portion 14 which is configured to connect to the handle seen in FIG. 1. The connection portion 14 may be provided as any known connector for a shaving head, and may be configured to allow a handle to connect permanently or temporarily to the housing 30. Although, in the example illustrated here, the connection portion 14 and the shaving area 40 are arranged on opposite sides of the housing 30 in the height direction H, such an arrangement is not intended to be limiting. As a non-limiting example, the connection portion 14 may depend from the rear portion 31, one or both lateral portions 32, 33, the front portion 34, or any combination thereof.

In the example illustrated here, the hair moving mechanism 60 includes a hair moving surface 80, which is arranged to come into contact with the skin during shaving. As seen in the example illustrated here, the hair moving surface 80 may be sized in the width direction W so as to extend in the width direction W across the entire shaving area 40. A polymer-containing material may be provided in the hair moving surface 80. The polymer-containing material provided in the hair moving surface 80 may for example be selected to provide sweeping of the skin. Non-limiting examples of polymer-containing materials which may be used to provide such a characteristic include one or more rubbers, one or more thermoplastic elastomers (TPEs) one or more plastics (including but not limited to acrylonitrile butadiene styrene, also known as "ABS"), or combinations thereof. It is also contemplated, however, for the polymer-containing material provided in the hair moving surface 80 to be any of the exemplary polymer-containing materials detailed earlier herein. Moreover, none of the materials presented for use in the hair moving surface 80 is intended to be limiting.

Regardless of the composition of the hair moving surface 80, the hair moving mechanism 60 also includes a drive mechanism 100. The drive mechanism 100 is configured to move at least a portion of the hair moving surface 80 that is in contact with the skin in a direction towards the cutting edge(s) of the blade(s) 50 whose cutting edges are arranged in the shaving area 40. The drive mechanism 100 may be configured to move the hair moving surface 80 faster with respect to the housing 30 than the movement of the skin with respect to the housing 30. As a non-limiting example, the drive mechanism 100 may be configured to move the hair moving surface 80 at least twice as fast with respect to the housing 30 as the movement of the skin with respect to the housing 30.

As a non-limiting example, the drive mechanism may be provided as a motor that is configured to move the hair moving surface faster than a typical speed at which a shaver is moved across skin during shaving.

The drive mechanism 100 may be configured to produce movement of the hair moving surface 80 in response to movement of the skin relative to the housing 30. For example, the drive mechanism 100 may include a motor and a sensor configured to detect movement of the skin relative to the housing 30 (for example optically). In the example illustrated here, however, the drive mechanism 100 is configured to convert the movement of the skin relative to the housing 30 into movement of the hair moving surface 80 relative to the housing 30.

In the example illustrated here, the drive mechanism 100 includes a drivetrain connecting the hair moving surface 80 to at least one driving wheel 110 which is arranged to contact the skin during shaving. Movement of the skin relative to the housing 30 causes rotation of the driving wheel 110, and is converted via the drivetrain into movement of the hair moving surface 80.

The driving wheel 110 presents a contact surface 112 which is brought into contact with skin during shaving. As seen in the example illustrated here, the contact surface 112 may be textured in order to limit or avoid slippage of the driving wheel 110 on the skin. Regardless of whether the contact surface 112 is textured or not, the driving wheel 110 may contain a high-friction material for contact with the skin, which is provided in the contact surface 112. The high-friction material may be chosen from one or more of the polymer-containing materials detailed earlier herein, though such exemplary materials are not intended to be limiting. Moreover, it is also contemplated to provide a non-polymeric high-friction material.

In examples, the hair moving surface 80 includes at least one fin 90 configured to sweep the skin as it comes into contact with it during shaving. As the fin 90 sweeps the skin in a direction that includes a component oriented opposite to a grain component of a strand of hair growing from the skin, the fin 90 may lift at least a portion the strand of hair away from the exposed surface of the skin, so as to increase said portion's perpendicularity with respect to the exposed surface of the skin. Increased perpendicularity may increase the closeness by which the blade(s) 50 in the cutting area 40 are able to shave the strand.

Although, in the example illustrated here, the hair moving surface 80 presents ten fins 90, it is also contemplated to provide a hair moving surface with nine, eight, seven, six, five, four, three, or two fins 90, or even to provide eleven or more fins 90.

In examples, hair moving surface 80 is provided on a roller 70 that is mounted rotatably in the housing 30 so as to be rotatable by the drive mechanism 100. The roller 70 may be configured to rotate faster than the driving wheel 110, for example at least twice as fast as the driving wheel 110.

The fin(s) 90 of the hair moving surface 80 extend(s) radially outwardly from a core of the roller 70 which connects the hair moving surface 80 to the housing 30. Although the example illustrated here shows the core and the fin(s) 90 as being formed monolithically with one another of a material common to both the fin(s) 90 and the core, it is also contemplated for the fin(s) 90 to be formed using a different material from the core, for example as with a plastic core on which the hair moving surface 80 is formed by co-injection of rubber thereon.

Whether the fin(s) 90 (and/or hair moving surface 80) is/are formed monolithically with the core of the roller 70 or not, the hair moving surface 80 is understood to be provided on the roller 70.

The drivetrain may be provided as a gear set linking the driving wheel(s) 110 to the hair moving surface 80 (for example to an axle of the roller 70). However other drivetrains are contemplated, for example as a belt drive or a chain drive.

The driving wheel 110 may be provided outside of the shaving area 40. In examples, the driving wheel 110 is provided in the width direction W with respect to the shaving area 40. Such an arrangement may reduce likelihood that a strand of hair would be subjected to a force in the shaving direction 9 by the driving wheel 110 as the strand of hair enters the shaving area 40. In the example shown here, the driving wheel 110 is arranged in the shaving direction 9 with respect to the hair moving surface 80. Other placements for the driving wheel 110 are also contemplated, such as in an opposite direction to the shaving direction 9 with respect to the shaving area 40, for example.

Figure 3:
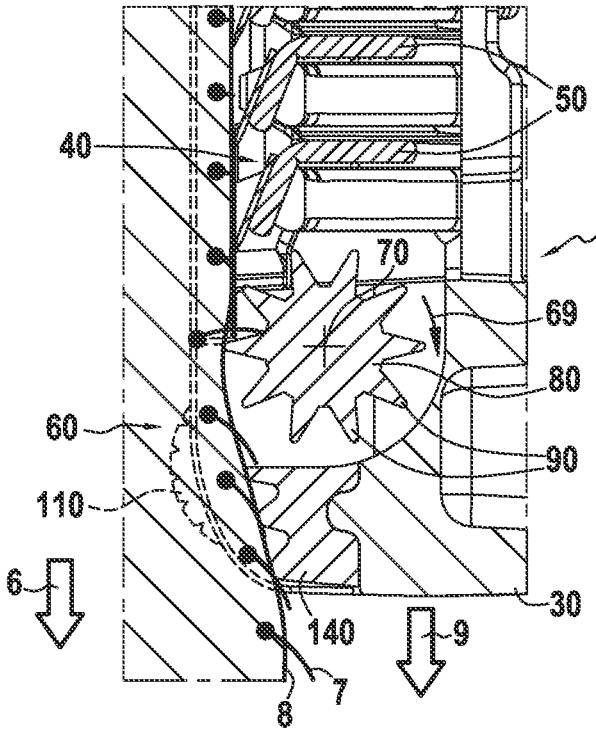
FIG. 3 shows the cut view of the shaving head visible in FIG. 1-2 during shaving.

FIG. 3 shows the cut view of the shaving head 20 visible in FIG. 1-2 during shaving of skin 8, with the shaving direction 9 oriented generally in the same direction as the grain direction 6 of the hair 7 growing from the skin 8. With a conventional shaver, such a shaving direction may be associated with reduced shaving closeness, for example due to individual strands' orientations reducing their accessibility to blades.

As seen in the illustrated example however, as the shaving head 20 moves in the shaving direction 9 with respect to the skin 8 and hair 7 protruding therefrom, the hair moving mechanism 60 moves the fins 90 and consequently the hair 7 with respect to the skin 8, and towards the blade(s) 50 whose cutting edge(s) is/are in the shaving area 40. Such movement temporarily alters the grain of the hair 7 in a vicinity of the hair moving mechanism 60, for example by altering the grain direction 6 of the hair 7 or by reducing the magnitude of individual strands' grain components. Such an alteration may improve shaving closeness when the shaving direction 9 is aligned with the grain direction 6, or when a path angle between the shaving direction 9 and the grain direction 6 is within a certain range.

The path angle is defined by a vertex and two rays extending therefrom: a shaving ray extending from the vertex in the shaving direction 9, and a grain ray extending away from the vertex in the grain direction 6. The term "path angle" as used herein refers to an angle of 180 degrees or less. A path angle of approximately 180 degrees corresponds to a shaving direction 9 which is substantially opposite to the grain direction 6; a path angle of approximately 0 degrees corresponds to a shaving direction 9 which is substantially the same as the grain direction 6. For a conventional shaving head, a path angle of more than 90 degrees typically corresponds to a closer shave than a path angle of less than 90 degrees. In the shaving head 20 illustrated here, however, the movement of the hair 7 relative to the skin 8 provided by the hair moving mechanism 60 may improve shaving closeness for a path angle of less than 90 degrees.

As the skin 8 moves past the housing 30 with given velocity and a direction opposite to the shaving direction 9, the skin 8 contacts the driving wheel 110. Due to contact with the housing 30 and/or the driving wheel 110, the skin 8 deflects away from the shaving head 20 in a direction normal to the exposed surface, relative to skin 8 which is brought into contact with the blade(s) 50 whose cutting edges are in the shaving area 40. Accordingly, in FIG. 3, since the exposed surface of the skin 8 is shown coming into contact with the cutting edges of the blades 50 in the shaving area, the skin 8 obscures portions of the housing 30 and driving wheel 110. These obscured portions of the shaving head 20 are therefore represented here using dashed lines.

Figure 4:
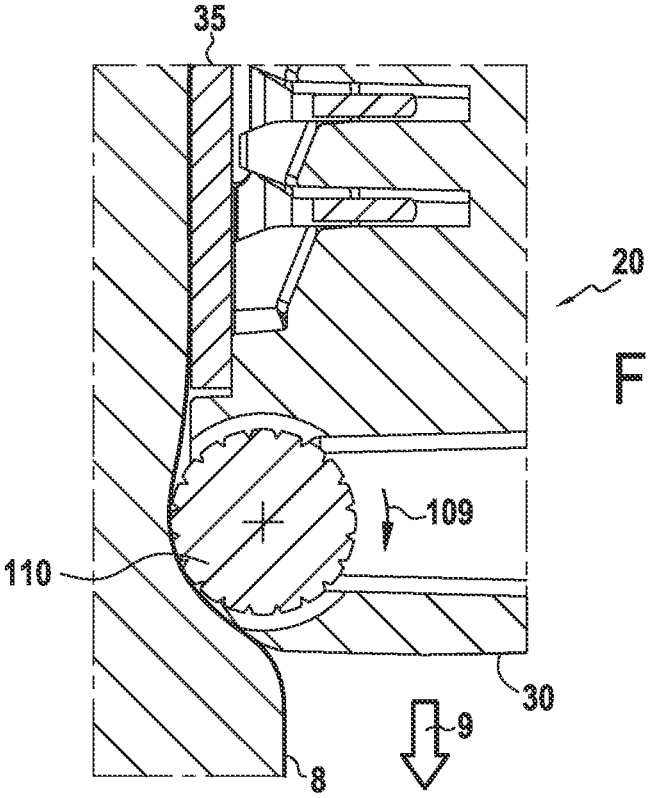
FIG. 4 shows a cut view of the shaving head visible in FIG. 1, as taken with respect to cut plane IV-IV during shaving.

FIG. 4 shows a cut view of the shaving head 20 visible in FIG. 1, as taken with respect to cut plane IV-IV during shaving. Due to contact with the driving wheel 110 while moving past the housing 30, the skin 8 imparts a tangential velocity to the driving wheel 110 that is approximately equivalent in magnitude and direction to the velocity of the skin with 8 with respect to the housing (in other words, its magnitude is approximately equal to the velocity of the shaving head 20 in the shaving direction 9, and its direction with respect to the housing 20 is approximately opposite to the shaving direction). Under the effect of this tangential velocity, the driving wheel 110 is made to roll on the skin 8 and rotate with respect to the housing 30. Torque from the driving wheel 110 is transferred through the drivetrain to the roller 70 (visible in FIG. 3).

Comparison of FIG. 3-4 reveals that the roller 70 rotates relative to the housing 30 in the same direction as the driving wheel 110, as indicated by the arrow 109 in FIG. 4, representing the direction of rotation of the driving wheel 110, and the arrow 69 in FIG. 3, representing the direction of rotation of the roller 70.

The tangential velocity of the hair moving surface 80, as measured at a location of the hair moving surface 80 in contact with the skin 8 (for example as measured at an outer radial extremity of a fin 90 in contact with the skin 8) has a direction relative to the housing 30 that is approximately opposite to the shaving direction. In the example illustrated here, its magnitude as measured relative to the housing 30 is approximately twice that of the velocity of the shaving head 20 in the shaving direction 9.

Since the speed of the hair moving surface 80 relative to the skin 8 during contact therewith is substantially higher than the speed of the housing 30 relative to the skin 8, hair 7 contacted by the hair moving surface 80 is moved relative to the skin 8 towards the blade(s) 50 whose edge(s) is/are present in the shaving area 40.

Additionally, in contrast with the shaving heads known from the documents EP3590669A1, WO2019141482A1, WO2019141488A1, EP3444084A1, and DE102004020650A1, the shaving head 20 of the present disclosure may (for example through the movement of the hair moving surface 80) impart a movement to hair 7 so as to lift strands away from the exposed surface of the skin 8. In other words, the movement of the hair 7 may include a component which is normal to the exposed surface of the skin 8. Such movement may cause a temporary increase in the length of a given strand of hair 7, as a portion of the strand which was concealed beneath the exposed surface of the skin 8 is pulled beyond the exposed surface of the skin 8, thereby becoming exposed. Subsequent to this temporary increase in length, the hair 7 may retract, drawing back at least some of the newly-exposed length of the strand to conceal it beneath the exposed surface of the skin 8. This behavior may be used to improve shaving closeness, by temporarily elongating hair 8 and shaving it before the retraction subsides.

In the example illustrated here, the rotation of the hair moving surface 80 may allow it to pull hair 7 away from the exposed surface of the skin 8, inducing this temporarily elongation shortly before the hair 7 is cut by the blade(s) 50 whose cutting edge(s) is/are in the shaving area 40.

Since the roller 70 is rotating at a speed that moves the hair moving surface 80 relative to the housing 30 substantially faster than the skin 8 moves relative to the housing 30, the hair moving surface 80 is able to apply tension to the hair 7 as the hair moving surface 80 slides on the hair 7.

The fin(s) 90 on the hair moving surface 80 may allow for strands of hair 7 to be swept gently away from the exposed surface of the skin 8, possibly into a position in which they may extend lengthwise into gaps provided between adjacent fins 90. In such a position, a fin 90 may be positioned to tug the strand of hair 7 away from the exposed surface of the skin 8. By bringing the strand of hair 7 into frequent and repeated contact with the fin(s) 90 of the hair moving surface 80 (for example by providing multiple fins 90 and/or by ensuring a speed of the hair moving surface 80 which is much higher relative to the housing 30 than the speed of the skin 8 relative to the housing 30), it may be possible to increase the extent of the temporary elongation of the hair 7, and/or delay retraction.

Such pulling and/or sweeping away of a strand of hair 7 from the exposed surface of skin 8 may allow the hair to be lifted.

As seen in the illustrated example, when a skin tensioning device 140 is present, providing the hair moving surface 80 in an opposite direction to the shaving direction 9 with respect to the skin tensioning device 140 may allow the skin tensioning device 140 to stretch the skin 8 by pulling it away from the blade(s) 50 of the shaving area 40, while still allowing the hair moving surface 80 to move hair 7 towards the blade(s) 50 of the shaving area 40. Moreover, such an arrangement may also reduce the likelihood that the skin 8 would go slack between the hair moving surface 80 and the blade(s) 50 of the shaving area 40. The hair moving mechanism 60 may be configured such that the contact force between the hair moving surface 80 and the skin 8 does not exceed the contact force between the skin tensioning device 140 and the skin 8.

Returning now to FIG. 1, it can be seen that, in the example illustrated here, the drive mechanism 100 includes two driving wheels 110, 110', located on opposite lateral sides of the housing 30 such that each is beyond the shaving area 40 in the width direction W.

Other configurations for converting the movement of the skin relative to the housing 30 into movement of the hair moving surface 80 are also contemplated, for example a continuous track device may be provided with wheels thereof arranged in series along the shaving direction 9, such that the track thereof may be movable relative to the housing 30 opposite to the shaving direction 9 when contacted by skin, and movement of the track is imparted to the wheels for transmission to the hair moving surface 80.

Each driving wheel 110, 110' (or equivalent) may, as seen in the example illustrated here, be housed in a lateral portion 32, 33 of the housing 30, at its intersection with the front portion 34 of the housing 30. It is also contemplated, however, that at least one driving wheel 110, 110' may be housed in the front portion 34 of the housing 30, medially of the lateral portions 32, 33, with the skin tensioning device 140 (when present) being shaped accordingly to accommodate the driving wheel(s) 110, 110'. Placing a driving wheel 110, 110' medially of the lateral portions may increase reliability of contact between the driving wheel(s) and the skin.

In the case of a continuous track device, it is contemplated that each continuous track device be housed in a lateral portion 32, 33 of the housing 30 extend from the intersection of the lateral portion 32, 33 with the front portion 34 to the intersection of the lateral portion 32, 33 with the rear portion 31 of the housing 30. The retainer 35 (when present) may be shaped so as to not interfere with the continuous track device.

Throughout the description, including the claims, the term "comprising a" should be understood as being synonymous with "comprising at least one" unless otherwise stated. In addition, any range set forth herein, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A shaving head configured to be moved along a shaving direction relative to skin during shaving of the skin, the shaving head including a housing, one or more blades mounted within the housing, and a hair moving mechanism connected to the housing and arranged in the shaving direction relative to the one or more blades, wherein the hair moving mechanism is configured to move hair relative to the skin in a direction towards the one or more blades during shaving such that movement of the shaving head on the skin brings hair extending from the skin into contact with the hair moving mechanism before bringing it in contact with the one or more blades, wherein the hair moving mechanism includes a hair moving surface which is arranged towards the skin during shaving, and a drive mechanism configured to move the hair moving surface relative to the housing in response to a movement of the skin relative to the housing, and the drive mechanism includes one or more driving wheels arranged to contact the skin, and a drivetrain connecting the driving wheels to the hair moving surface.

2. The shaving head of claim 1, wherein the hair moving surface includes one or more fins configured to sweep the skin during shaving.

3. The shaving head of claim 1, wherein the drive mechanism is configured to convert the movement of the skin relative to the housing into movement of the hair moving surface relative to the housing.

4. The shaving head of claim 1, wherein the hair moving surface is sized in a width direction so as to extend in the width direction across an entire shaving area, in which the one or more blades cut hair during shaving.

5. The shaving head of claim 4, wherein the hair moving surface is provided with a polymer-containing material selected to provide sweeping of the skin.

6. The shaving head of claim 4, wherein one or more driving wheels are located laterally of a shaving area, in which the one or more blades cut hair during shaving, with respect to the shaving direction.

7. The shaving head of claim 1, wherein the drive mechanism comprises a drivetrain that comprises a gear set linking the driving wheels to the hair moving surface.

8. The shaving head of claim 1, wherein the hair moving surface is provided on a roller mounted rotatably in the housing so as to be rotatable by the drive mechanism.

9. The shaving head of claim 8, wherein the roller is configured to rotate faster than the driving wheels.

10. The shaving head of claim 8, wherein the roller is configured to rotate at least twice as fast as the driving wheels.

11. The shaving head of claim 1, including a skin tensioning device arranged in the shaving direction relative to the hair moving mechanism.

12. The shaving head of claim 11, wherein the skin tensioning device comprises one or more guard fins.

13. The shaving head of claim 11, wherein the skin tensioning device is configured to provide a lubricating function.

14. The shaving head of claim 1, wherein the hair moving mechanism comprises a polymer-containing material arranged to contact the skin during shaving.

15. The shaving head of claim 1, wherein the hair moving mechanism is housed within a front portion of the housing.

16. A shaving head configured to be moved along a shaving direction relative to skin during shaving of the skin, the shaving head including a housing, one or more blades mounted within the housing, and a hair moving mechanism connected to the housing and arranged in the shaving direction relative to the one or more blades, wherein the hair moving mechanism is configured to move hair relative to the skin in a direction towards the one or more blades during shaving such that movement of the shaving head on the skin brings hair extending from the skin into contact with the hair moving mechanism before bringing it in contact with the one or more blades, and wherein the hair moving mechanism includes a hair moving surface and the shaving head includes a drive mechanism including one or more drive wheels, the drive wheels of the drive mechanism and the hair moving mechanism each having a central axis and the central axes of the hair moving mechanism and the drive wheels having a different perpendicular distance from a shaving plane formed by the one or more blades.

17. The shaving head of claim 16, wherein the drive mechanism is configured to convert the movement of the skin relative to the housing into movement of the hair moving surface relative to the housing.

18. The shaving head of claim 16, wherein the drive mechanism comprises a drivetrain that comprises a gear set linking the driving wheels to the hair moving surface.

19. The shaving head of claim 16, wherein the hair moving surface is provided with a polymer-containing material selected to provide sweeping of the skin.

20. A shaver comprising:

a handle; and a shaving head, the shaving head comprising:

a housing, one or more blades mounted within the housing, and a plurality of hair moving surfaces mounted on a roller and connected to the housing and arranged in a shaving direction relative to the one or more blades, wherein the plurality of hair moving surfaces move hair relative to the skin in a direction towards the one or more blades during shaving such that movement of the shaving head on the skin rotates the roller and brings hair extending from the skin into contact with the at least one of the plurality of hair moving surfaces before bringing it in contact with the one or more blades, wherein the plurality of hair moving surfaces are arranged towards the skin during shaving, and a drive mechanism is configured to move the hair moving surfaces relative to the housing in response to a movement of skin relative to the housing, and the drive mechanism includes one or more driving wheels arranged to contact the skin, and a drivetrain connecting the driving wheels to the hair moving surface.

* * * * *